US007845829B2

(12) United States Patent
Shaner

(10) Patent No.: US 7,845,829 B2
(45) Date of Patent: Dec. 7, 2010

(54) ENCLOSURES FOR LED CIRCUIT BOARDS

(75) Inventor: Jeff Shaner, Covington, GA (US)

(73) Assignee: ABL IP Holding LLC, Conyers, GA (US)

( * ) Notice: Subject to any disclaimer, the term of this patent is extended or adjusted under 35 U.S.C. 154(b) by 79 days.

(21) Appl. No.: 12/123,839

(22) Filed: May 20, 2008

(65) Prior Publication Data

US 2009/0290345 A1 Nov. 26, 2009

(51) Int. Cl.
*F21V 21/00* (2006.01)

(52) U.S. Cl. ..... 362/249.02; 362/240; 362/244

(58) Field of Classification Search .....
362/249.01–249.02, 631, 240, 374, 800, 362/249.07, 612, 632–634, 646, 244
See application file for complete search history.

(56) References Cited

U.S. PATENT DOCUMENTS

| | | | | |
|---|---|---|---|---|
| 3,950,844 | A | 4/1976 | Wisbey | |
| 4,336,580 | A | 6/1982 | Mouyard et al. | |
| 4,724,629 | A | 2/1988 | Walton | |
| 4,935,665 | A | 6/1990 | Murata | |
| 4,967,317 | A | 10/1990 | Plumly | |
| 5,061,745 | A | 10/1991 | Wittmann et al. | |
| 5,120,778 | A * | 6/1992 | Price et al. | 524/94 |
| 5,433,295 | A | 7/1995 | Murphy | |
| 5,771,617 | A | 6/1998 | Baker | |
| 5,785,414 | A | 7/1998 | Baker et al. | |
| 6,244,727 | B1 * | 6/2001 | Ryan et al. | 362/244 |
| 6,318,886 | B1 | 11/2001 | Stopa et al. | |
| 6,367,949 | B1 | 4/2002 | Pederson | |
| 6,939,905 | B2 | 9/2005 | Seidel et al. | |
| 7,019,283 | B2 * | 3/2006 | Howe | 250/239 |
| 7,044,620 | B2 | 5/2006 | Van Duyn | |
| 7,055,987 | B2 | 6/2006 | Staufert | |
| 7,163,324 | B2 | 1/2007 | Pederson | |
| 7,175,303 | B2 | 2/2007 | Kovacik et al. | |
| 7,204,602 | B2 | 4/2007 | Archer | |
| 7,281,818 | B2 | 10/2007 | You et al. | |

(Continued)

FOREIGN PATENT DOCUMENTS

DE 2004015221 3/2005

(Continued)

OTHER PUBLICATIONS

"Ultra-Bright WATT-MAN™ White LED Retrofit Lamp", WATT-MAN LED Lighting—2006, 2 pgs.

(Continued)

*Primary Examiner*—Thomas M Sember
(74) *Attorney, Agent, or Firm*—Kilpatrick Stockton LLP

(57) ABSTRACT

An enclosure for an LED circuit board is manufactured from a flame resistant material and includes LED apertures through which LEDs mounted on an LED circuit board may pass. The enclosure is designed to be positioned on the LED circuit board so that, when so positioned, the LEDs extend at least partially through the LED apertures in the enclosure. When the enclosure is positioned on the board, portions of its lower surface contact the upper surface of the board. Various fixation/retention methods may be used to retain the enclosure in position relative to the circuit board. It is preferable that such methods allow for the separation of the enclosure from the board.

16 Claims, 3 Drawing Sheets

U.S. PATENT DOCUMENTS

| | | | | |
|---|---|---|---|---|
| 7,303,315 | B2 | 12/2007 | Ouderkirk et al. | |
| 7,559,673 | B2 * | 7/2009 | Meersman et al. | 362/245 |
| 2004/0085779 | A1 * | 5/2004 | Pond et al. | 362/516 |
| 2004/0223327 | A1 | 11/2004 | Kuan et al. | |
| 2004/0233671 | A1 | 11/2004 | Staufert | |
| 2005/0116235 | A1 | 6/2005 | Schultz et al. | |
| 2005/0242721 | A1 | 11/2005 | Foust et al. | |
| 2006/0092637 | A1 | 5/2006 | Yeh | |
| 2006/0262545 | A1 | 11/2006 | Piepgras et al. | |
| 2006/0293427 | A1 | 12/2006 | Martens et al. | |
| 2007/0103902 | A1 | 5/2007 | Hsiao | |
| 2007/0201225 | A1 | 8/2007 | Holder et al. | |
| 2007/0223226 | A1 | 9/2007 | Park | |
| 2007/0263376 | A1 * | 11/2007 | Wilkinson et al. | 362/35 |
| 2008/0272380 | A1 | 11/2008 | Wilcox | |
| 2008/0273325 | A1 | 11/2008 | Wilcox et al. | |
| 2008/0273326 | A1 | 11/2008 | Wilcox et al. | |
| 2008/0273327 | A1 * | 11/2008 | Wilcox et al. | 362/267 |
| 2008/0273341 | A1 | 11/2008 | Wilcox et al. | |

FOREIGN PATENT DOCUMENTS

| | | | |
|---|---|---|---|
| EP | 1187522 | A2 | 3/2002 |
| EP | 1750240 | A1 | 2/2007 |
| JP | 11-100513 | | 4/1999 |
| JP | 11-133760 | | 5/1999 |
| JP | 2000-004075 | | 1/2000 |
| JP | 2004-269552 | | 9/2004 |
| WO | WO 94/10673 | | 5/1994 |

OTHER PUBLICATIONS

"LED Security Detention Fixture—Night Light Lamp", WATT-MAN LED Lighting—2006, 2 pgs.
"Amber LED Healthcare Night Light Fixture Retrofit Lamp", WATT-MAN LED Lighting—2006, 2 pgs.
"Amber LED Night Light Stick Lamp", WATT-MAN LED Lighting—2006, 2 pgs.

* cited by examiner

ENCLOSURES FOR LED CIRCUIT BOARDS

FIELD OF THE INVENTION

Embodiments of the invention relate to non-flammable enclosures for LED circuit boards.

BACKGROUND OF THE INVENTION

The use of light emitting diodes ("LED") in lighting fixtures to supply the desired illumination is becoming more prevalent. However, the voltage necessary to power an LED circuit board for use in lighting fixtures oftentimes renders the board a non-Class 2 component as defined by the National Electric Code ("NEC"). See NEC (specifically Section 725 and Table 11(B)) (2005), the entirety of which is herein incorporated by reference. Existing LED circuit boards which operate beyond the limits of Class 2 power are designated by UL as a "risk of fire" and must be contained. See UL 8750 (specifically section 3.17)(2008), the entirety of which is herein incorporated by reference. Containment requires that the LED board be enclosed so that a person cannot easily come into contact with the board. More specifically, the enclosure must be manufactured from a 5VA compliant material (one that passes stringent flammability testing pursuant to UL 94, the entirety of which is herein incorporated by reference) and the board must not be easily accessible. See UL 8750, Table 9.1. For example, the enclosure cannot be removed easily so as to gain access to the board. Rather, it should be sufficiently secured so that tools are required for its removal.

Enclosures have traditionally taken the form of a glass refractor that is secured in a lighting fixture a distance from the LED board. The refractor thereby prevents easy access to the LED board within the fixture. However, refractors are traditionally made of glass, which, while 5VA compliant, can be prone to break and thereby present additional risks to handlers. Moreover, because the light emitted from the LEDs in such fixtures must pass through the glass refractor, some of the light is lost, thereby impacting the efficiency and effectiveness of the fixture. While metal is also a 5VA compliant material, use of it in the fixture elevates the risk of electric shock and, given that it is nontransparent, impedes the transmission of the light emitted from the LEDs. Given the difficulty in designing a enclosure that satisfies the 5VA flammability rating without introducing other potential safety hazards, lighting fixture manufacturers have typically resorted to use of less hazardous Class 2 or Class 3 power sources. In this way, overall lighting system efficiency is sacrificed to avoid the need to comply with the strict requirements promulgated by the UL and NEC.

SUMMARY OF EMBODIMENTS OF THE INVENTION

Embodiments of this invention provide an enclosure for an LED circuit board. The enclosure is manufactured from a flame resistant material and includes LED apertures through which the LEDs mounted on an LED circuit board may pass. The enclosure is designed to be positioned on the LED circuit board so that, when so positioned, the LEDs extend at least partially through the LED apertures in the enclosure. When the enclosure is positioned on the board, portions of its lower surface contact the upper surface of the board. Various fixation/retention methods may be used to retain the enclosure in position relative to the circuit board. It is preferable that such methods allow for the relatively easy separation of the enclosure from the board.

DETAILED DESCRIPTION OF EMBODIMENTS OF THE INVENTION

Embodiments of this invention provide an enclosure for an LED circuit board. While the enclosure is discussed for use with circuit boards incorporated into lighting fixtures, it by no means is so limited. Rather, the enclosure may be used with LED circuit boards used in any application.

The enclosure 10 is manufactured from 5VA compliant material, such as, but not limited to, flame resistant polymeric materials, metal, and glass. While use of a metal or glass to manufacture the enclosures is certainly within the scope of embodiments of the invention, given their drawbacks discussed above, they are not the most preferred materials from which to make the enclosures. Rather, flame resistant polymeric materials are more preferable, with polycarbonate being the most preferable. Suitable polycarbonates include GE 503R (f1) (available from General Electric), Dow CALIBRE 893w (available from The Dow Chemical Company), and Bayer MAKROLON 6555 (available from Bayer MaterialScience). The flame resistant polymeric materials are preferably, but not necessarily, opaque. Use of polymeric materials allows the enclosure to be injection-molded, but other manufacturing methods, such as, but not limited to, machining, stamping, compression-molding, etc., may also be employed.

Figure 1:
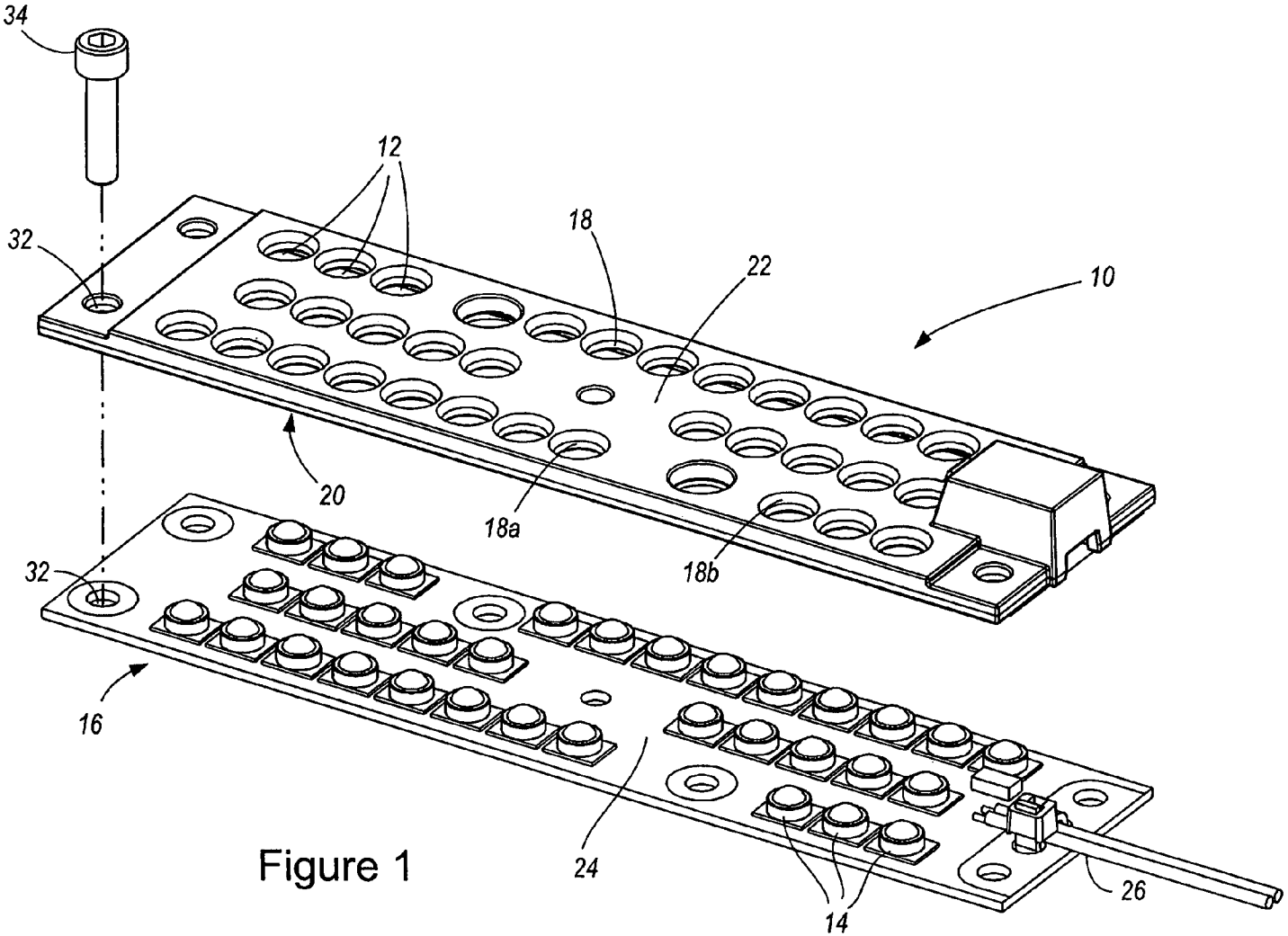
FIG. 1 is an exploded view of an enclosure according to one embodiment of the present invention and an LED circuit board.
Figure 2:
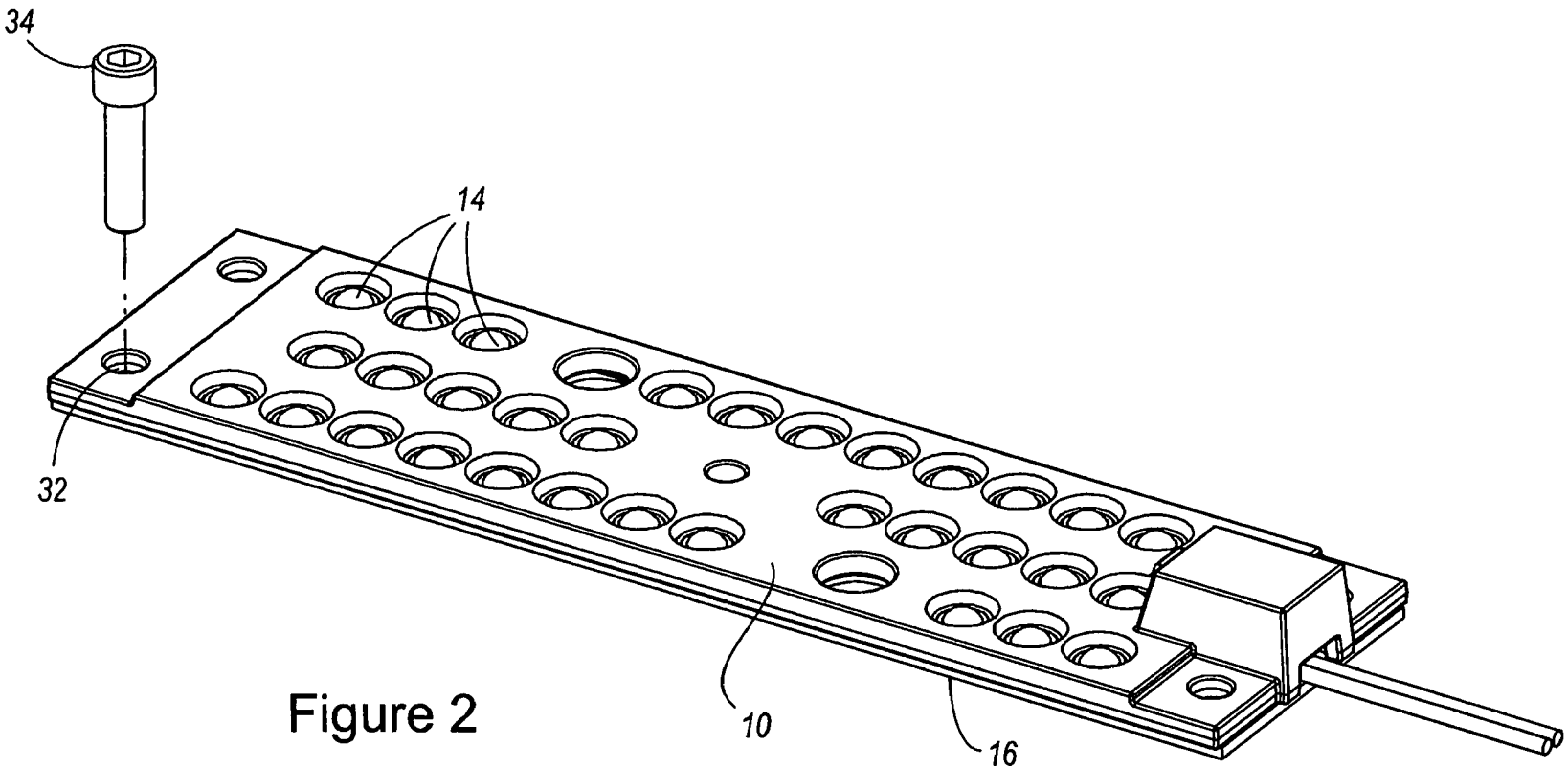
FIG. 2 is a perspective view of the enclosure of FIG. 1 positioned on the LED circuit board.

As shown in FIGS. 1 and 2, the enclosure 10 includes LED apertures 12 through which the LEDs 14 mounted on an LED circuit board 16 may pass. Any number of LED apertures 12 may be provided in the enclosure 10, depending on the number of LEDs 14 on the board 16. While the LED apertures 12 illustrated in FIG. 1 are circular-shaped, they need not be. Rather, the LED apertures 12 may be of any shape that allows the LEDs 14 to pass through the apertures 12. It is preferable, but not required, that the LED apertures 12 be sized to closely accept the LEDs 14 so that, when the enclosure 10 is positioned on the board 16, at least a part of the walls 18 that define the LED apertures 12 closely conform to the LEDs 14. While the LED apertures 12 are positioned around the LEDs 14, preferably no part of the enclosure 10 is positioned over the LEDs 14 so as to cover the LEDs (and particularly the LED lenses). Such a design permits the direct transmission of light from the LEDs 14.

While the LED apertures 12 may be in the shape of a straight cylinder, in the embodiment illustrated in FIG. 1 the LED apertures 12 are defined by a straight wall section 18*a* proximate the lower surface 20 of the enclosure 10 and a chamfered wall section 18*b* proximate the upper surface 22 of the enclosure 10. Provision of a chamfered wall section 18*b* further ensures that the transmission of light by an LED 14 positioned in an aperture 12 is not impeded by the aperture walls 18. While FIG. 1 illustrates two distinct wall sections 18*a*, 18*b*, it is conceivable that a continuous wall could define the LED apertures 12. Such a wall could be frusto-conical or gradually curve outwardly towards the upper surface 22 of the enclosure 10 to prevent impediment of light transmission. In such embodiments, the aperture opening in the lower surface 20 of the enclosure 10 is smaller than the aperture opening in the upper surface 22 of the enclosure 10. While not required, portions of the aperture walls 18 (and particularly the chamfered wall section 18*b*) may be treated with a metallic compound, such as, but not limited to, aluminum, silver, gold, lead, etc., so that the aperture walls 18 serve as a refractor to direct light emitted by the LEDs 14 as desired.

The enclosure 10 is designed to be positioned on the LED circuit board 16 so that, when so positioned, the LEDs 14 extend at least partially through the LED apertures 12 in the enclosure 10 (see FIG. 2). The minimum enclosure 10 thickness is determined by the UL 94 flammability tests. To keep material costs to a minimum, it may be desirable, but not required, to use the minimum thickness which still passes the 5VA requirement, although thicker cross sections are acceptable. Thicknesses between approximately 0.020 and 0.125 inches will typically be suitable. The thickness of the enclosure 10 need not be consistent along its entire length. Moreover, it may be preferable, but not required, that the enclosure thickness be such that, when the enclosure 10 is positioned on the board 16, portions of the LEDs 14 extend a distance above the upper surface 22 of the enclosure 10. Such relative geometry reduces the likelihood that the enclosure 10 will impede emission of light from the LEDs 14.

When the enclosure 10 is positioned on the board 16, the lower surface 20 of the enclosure 10 can, but need not, contact the entirety of the upper surface 24 of the board 16. It is preferable, however, that the enclosure 10 be designed to ensure contact with the upper surface 24 of the board 16 along the perimeter of the board 16. In this way, dirt and other debris is prevented from penetrating between the enclosure 10 and the board 16. One of skill in the art will readily understand that, depending on the spatial relationship between the board 16 and the enclosure 10, it may be necessary to accommodate on the lower surface 20 of the enclosure 10 other anatomical features of the board 16, such as, for example, resisters, wire leads (see, e.g., 26), and other circuits.

The enclosure 10 may be tailored to accommodate any circuit board 16 configuration. While the embodiment illustrated in FIGS. 1 and 2 provides a one to one correspondence between the LED apertures 12 and the LEDs 14, such must not always be the case. Rather, a single LED aperture 12 could be sized to accommodate a plurality of LEDs 14. Moreover, while the enclosure 10 can be sized to approximate the dimensions of the circuit board 16 (as shown in FIGS. 1 and 2), the enclosure 10 could be sized larger or smaller than the board 16, if desired.

Figure 3:
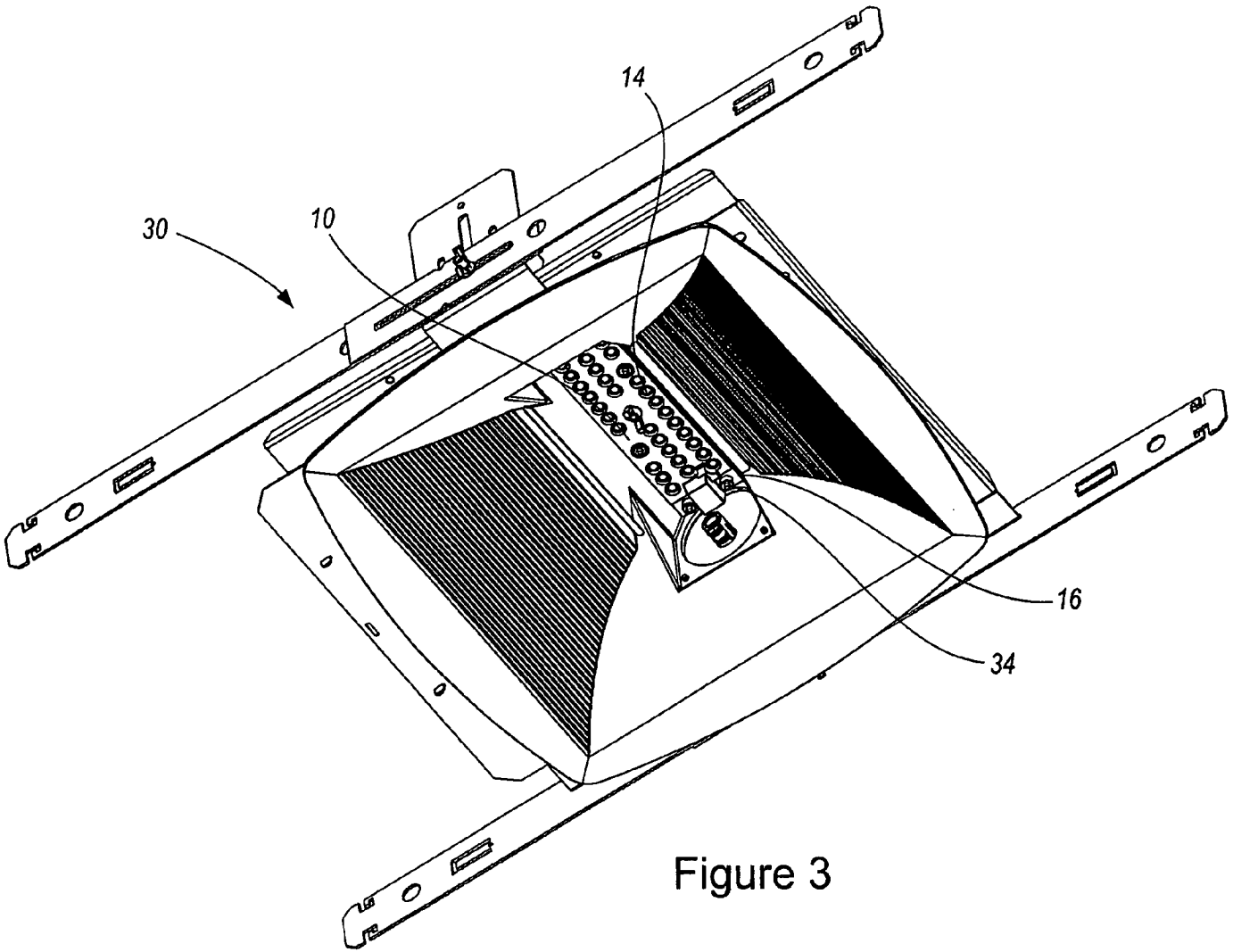
FIG. 3 is a perspective view of the enclosure and circuit board of FIG. 2 positioned in a lighting fixture.

The enclosure 10 may be retained in position relative to the board 16 in a variety of ways. The enclosure 10 may be fixed directly to the board 16 or can be fixed to other components in a lighting fixture, such as the recessed lighting fixture 30 illustrated in FIG. 3. In the embodiment illustrated in FIGS. 1 and 2, the enclosure 10 and board 16 each includes fastener holes 32 for receiving fasteners (such as a screw 34). Any number of fastener holes 32 capable of effecting sufficient fixation may be used. The screws 34 extend through the fastener holes 32 to retain the board 16 and enclosure 10 together.

The enclosure 10 need not be fixed directly to the board 16, however. Rather, the enclosure 10 may be positioned on the board 16 and screwed either directly or indirectly to other components in the fixture 30. For example, the screw 34 illustrated in FIG. 1 can extend through the fastener holes 32 in the enclosure 10 and board 16 and further extend into another fixture component (such as a heat sink (not shown) located adjacent the board 16) to provide an indirect connection between the enclosure 10 and other fixture component. Alternatively, the enclosure 10 can be sized to enable direct fixation to another fixture component (such as a heat sink). This could happen, for example, if the enclosure 10 is sized larger than the board 16 in at least one dimension.

While a screw 34 is depicted in the figures, any mechanical retention device may be used to secure the enclosure 10 in a lighting fixture 30, including but not limited to, spring clips, bolts and wing nuts, rivets, resilient arms, etc. It is conceivable that grooves may be provided in a fixture component (such as a heat sink) and the board 16 and enclosure 10 mated and retained within the groove, pressed firmly within the grooves and against each other.

While various fixation/retention methods are contemplated, it is preferable, but not required, that such methods allow for the separation of the enclosure from the board (without damaging either component) for the purpose of inspection or upgrading of the components.

The enclosures pursuant to embodiments of this invention comply with the stringent "containment" requirements for high voltage non-Class 2 LED circuit boards. Thus, in conjunction with the enclosures, such higher voltage LED circuit boards may be used in lighting fixtures (such as the recessed lighting fixture 30 illustrated in FIG. 3) and the higher efficiencies that stem from such use realized. Moreover, the design of such enclosures does not impair transmission of light from the LEDs, rendering more effective the lighting fixtures in which the LEDs are incorporated.

The foregoing is provided for purposes of illustrating, explaining, and describing embodiments of the present invention. Further modifications and adaptations to these embodiments will be apparent to those skilled in the art and may be made without departing from the scope or spirit of the invention.

I claim:

1. An enclosure for a circuit board comprising:

a. an upper surface;

b. a lower surface; and c. at least one LED aperture that extends from the lower surface to the upper surface for receiving an LED mounted on the circuit board, wherein the circuit board is a non-Class 2 LED circuit board, wherein the enclosure comprises a flame resistant polymeric material, wherein the flame resistant polymeric material is 5VA compliant, and wherein the enclosure is positionable on the circuit board so that at least portions of the lower surface of the enclosure directly contact substantially the entirety of an upper surface of the circuit board, and wherein the enclosure is separable from the circuit board.

2. The enclosure of claim 1, wherein the flame resistant polymeric material comprises polycarbonate.

3. The enclosure of claim 1, wherein the at least one LED aperture is defined by at least one aperture wall.

4. The enclosure of claim 3, wherein the at least one aperture wall comprises a chamfered wall section.

5. The enclosure of claim 3, wherein at least a portion of the at least one aperture wall comprises a metallic compound.

6. The enclosure of claim 1, wherein the at least one LED aperture comprises an opening on the upper surface and the lower surface of the enclosure and wherein the opening on the upper surface is larger than the opening on the lower surface.

7. The enclosure of claim 1, wherein the at least one LED aperture is sized to receive a single LED.

8. The enclosure of claim 1, wherein the at least one LED aperture is sized to receive a plurality of LEDs.

9. An assembly comprising:

a. a circuit board comprising at least one LED mounted on the circuit board, wherein the circuit board is a non-Class 2 LED circuit board; and b. an enclosure positioned on the circuit board, the enclosure comprising:

i. an upper surface;

ii. a lower surface; and iii. at least one LED aperture that extends from the lower surface to the upper surface and receives the at least one LED mounted on the circuit board, wherein the enclosure comprises a flame resistant polymeric material, wherein the flame resistant polymeric material is 5VA compliant, and wherein the enclosure is positionable on the circuit board so that at least portions of the lower surface of the enclosure directly contact substantially the entirety of an upper surface of the circuit board, and wherein the enclosure is separable from the circuit board.

10. The enclosure of claim 9, wherein the enclosure is secured in place relative to the circuit board.

11. The assembly of claim 10, wherein the enclosure is secured in place relative to the circuit board via at least one mechanical fastener.

12. The enclosure of claim 11, wherein the enclosure is separable from the circuit board by removing or adjusting the at least one mechanical fastener.

13. The assembly of claim 9, further comprising a lighting fixture.

14. The assembly of claim 13, wherein the enclosure is secured in the lighting fixture via at least one mechanical fastener.

15. The assembly of claim 14, wherein the at least one mechanical fastener is removable or adjustable to allow the enclosure to be separated from the circuit board.

16. A lighting fixture comprising:

a. a circuit board comprising a plurality of LEDs mounted on the circuit board, wherein the circuit board is a non-Class 2 LED circuit board; and b. an enclosure positioned on the circuit board, the enclosure comprising:

i. an upper surface;

ii. a lower surface; and iii. a plurality of LED apertures that extends from the lower surface to the upper surface and receive the LEDs mounted on the circuit board, wherein the enclosure comprises polycarbonate, wherein the polycarbonate is 5VA compliant, and wherein the enclosure is positionable on the circuit board so that at least portions of the lower surface of the enclosure directly contact substantially the entirety of an upper surface of the circuit board, and wherein the enclosure is separable from the circuit board.

* * * * *